US006607406B2

(12) United States Patent
Banas et al.

(10) Patent No.: US 6,607,406 B2
(45) Date of Patent: Aug. 19, 2003

(54) NONPOLARIZED ELECTRICAL CONNECTOR ASSEMBLY ESPECIALLY FOR USE AS AUTOMOTIVE SQUIB CONNECTOR

(75) Inventors: Michael Henry Banas, Kernersville, NC (US); David J. Rhein, Memphis, MI (US)

(73) Assignee: Tyco Electronics Corporation, Middletown, PA (US)

( * ) Notice: Subject to any disclaimer, the term of this patent is extended or adjusted under 35 U.S.C. 154(b) by 33 days.

(21) Appl. No.: 10/067,525

(22) Filed: Feb. 5, 2002

(65) Prior Publication Data

US 2002/0123269 A1 Sep. 5, 2002

Related U.S. Application Data

(60) Division of application No. 09/863,653, filed on May 23, 2001, now Pat. No. 6,398,590, which is a continuation-in-part of application No. 09/613,706, filed on Jul. 11, 2000, now abandoned.

(51) Int. Cl.[7] ..... H01R 24/04
(52) U.S. Cl. ..... 439/668
(58) Field of Search ..... 439/668, 395, 439/21–26, 29, 669, 391

(56) References Cited

U.S. PATENT DOCUMENTS 5,070,605 A * 12/1991 Daglow et al. ..... 29/842
5,338,215 A * 8/1994 Lee et al. ..... 200/51.1
5,772,460 A * 6/1998 Baumann ..... 439/352
6,435,917 B1 * 8/2002 McDonald et al. ..... 439/206

* cited by examiner

*Primary Examiner*—Tulsidas Patel

(57) ABSTRACT

A nonpolarized electrical connector assembly (10) includes a receptacle connector subassembly (20) and a plug connector subassembly (100). The receptacle connector subassembly (20) can be mated with an electronic component subassembly, such as an airbag inflation initiator or squib (2), and includes a cylindrical housing (22) with a central plug passage (38). Receptacle contacts (50A, 50B and 50C) are positioned at different arcuate locations in this passage (38) with resilient cantilever beams (56) of different lengths so that contact points (58) on the beams (56) are at different axial locations in the passage (38). A plug connector subassembly has axially spaced cylindrical plug contacts (102A, 102B) and (102C) on a plug post (106) that is inserted into the passage (38) so that the plug connector subassembly (100) can be positioned at any angular position relative to the mating axis between the two connector subassemblies.

8 Claims, 13 Drawing Sheets

FIG 2
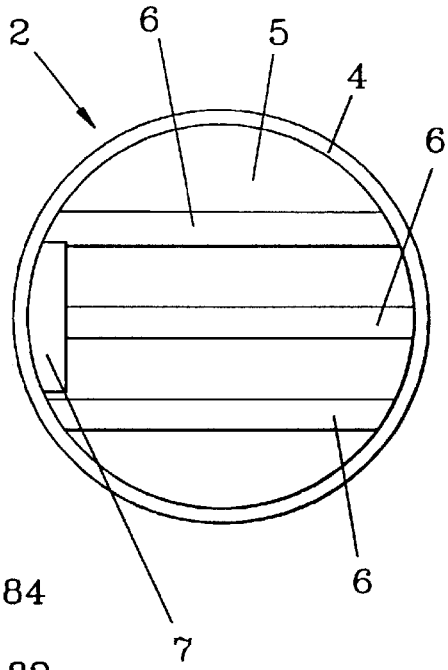
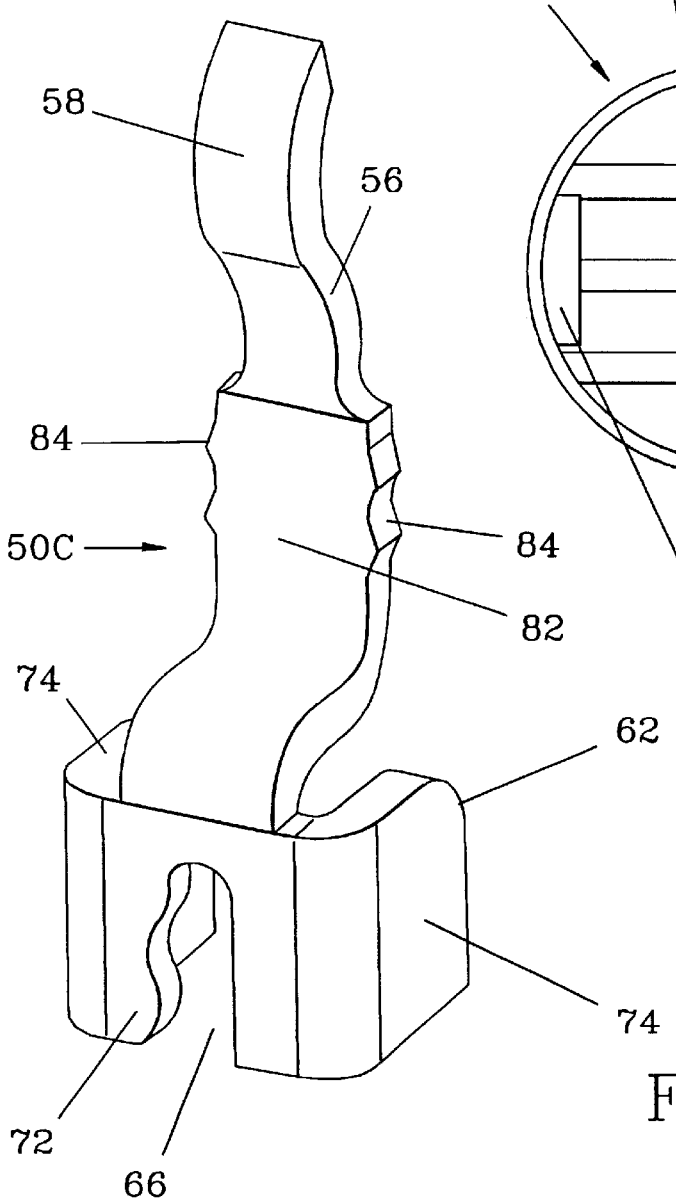
FIG 6

FIG 7A
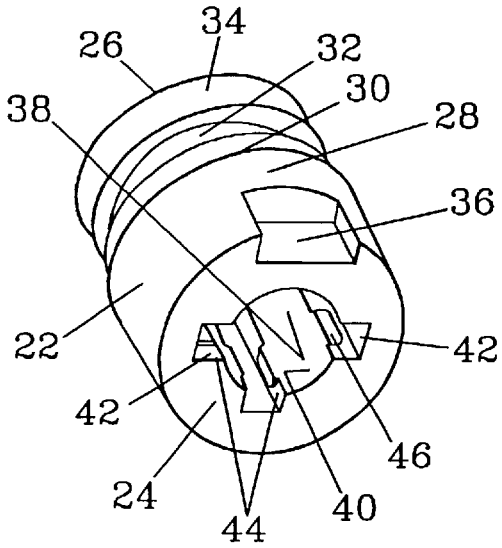
FIG 7B
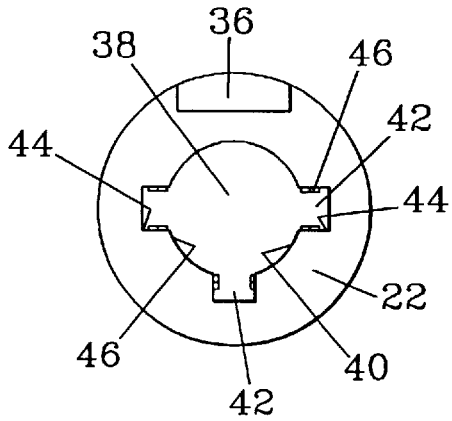
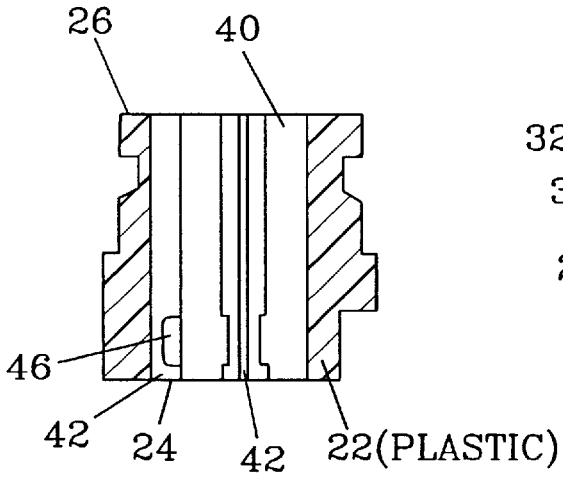
FIG 7D
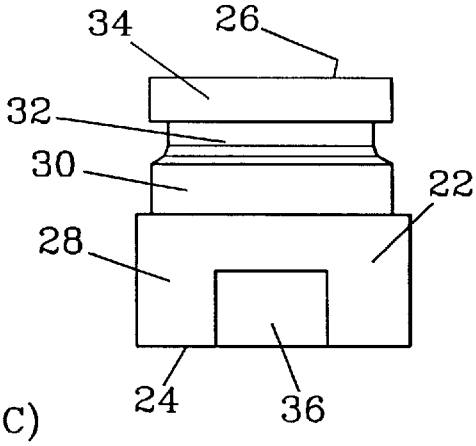
FIG 7C

NONPOLARIZED ELECTRICAL CONNECTOR ASSEMBLY ESPECIALLY FOR USE AS AUTOMOTIVE SQUIB CONNECTOR

This application is Divisional of prior application Ser. No. 09/863,653, filed May 23, 2001, now U.S. Pat. No. 6,398,590, which is Continuation in Part of prior application Ser. No. 09/613,706, filed Jul. 11, 2000, now abandoned.

BACKGROUND OF THE INVENTION

1. Field of the Invention

This invention is directed to electrical connectors comprising a plug and receptacle assembly for use in transmitting electrical signals on more than one signal path. This invention is more specifically directed to electrical connectors that do not require polarization. This electrical connector assembly employs axially spaced contacts in one connector and arcuately spaced contacts in a mating connector with the arcuately spaced contacts having axially spaced contact points to engage the axially spaced contacts in the mating electrical connector. This invention is also related to electrical connectors for use in automotive applications, such as electrical connectors for airbag inflation initiators or squibs.

2. Description of the Prior Art

Vehicle airbag systems typically include an airbag unit mounted within the cabin of the vehicle in order to protect the occupant in the event of an accident and a deceleration or other sensor that is typically not in the vicinity of the inflatable airbag. In order to deploy the airbag, an airbag inflation initiator or squib is activated in response to a signal from the sensor. The conventional squib unit typically contains an explosive material, such as gun powder, that is fired upon receipt of an electrical signal to cause the rapid release of high pressure gas to inflate the airbag. The squib is therefore typically part of the airbag unit. A squib electrical connector is normally mated to the airbag inflation initiator or squib in order to connect lead wires or other conductors leading from the sensor unit. The electrical connector system permits independent assembly of the airbag unit and the sensor or the remainder of the airbag system, and also permits subsequent connection and disconnection for servicing or repair.

Conventional squib units typically employ two terminal pins and when a current flows through both pins, the squib is activated and the airbag is inflated. Typically the two pins are located side by side. To prevent inadvertent actuation of the squib a shorting bar is normally mounted on both pins and when the squib connector is mated to the pins, the shorting bar is forced away from one of the pins. These conventional squib connector assemblies are also generally polarized so that the wrong pin is not connected to the sensor to permit inadvertent inflation of the airbag or to insure that the airbag will properly inflate upon receipt of a signal. In some cases, ferrites are also added to the interconnection system to prevent unwanted frequencies due to external interference. U.S. Pat. No. 6,029,995 shows a relatively recent example of a mechanism for inflating an airbag as part of a vehicle restraint system. U.S. Pat. No. 5,435,754 and U.S. Pat. No. 5,653,606 show two examples of electrical connectors that can be employed with conventional squib units. U.S. Pat. No. 5,993,230 discloses a different technique in which a single pin connection is employed in conjunction with a surrounding electrically conductive annular ground plate so that the plug connector can be attached in what is termed and orientationless fashion.

The evolution of passive or supplemental vehicle restraint systems, such as airbags, has led to use of airbags in areas other than the vehicle dash. Side cushion airbags and smaller airbags protecting against other eventualities have been proposed and introduced. In some cases these other airbags must be assembled as a smaller unit, which has resulted in a demand for smaller electrical connector assemblies for use with these newer devices. In some cases, these airbags must be mounted in areas, such as door panels where space is limited. Therefore there is a need to eliminate the polarity or specific orientation of the electrical connector so that the airbag assembly will either fit in certain areas or can be assembled without excessive effort. Elimination of shorting clips and ferrites is also desirable if for no other reason than to eliminate the cost associated with those additional devices. One approach that has been considered for use with new smart airbag systems is to incorporate an active integrated circuit into the airbag unit or into the airbag inflation initiator or smart squib. This integrated circuit can then communicate with an external sensor or controller using two or three signal paths and the squib would be activated only upon receipt of a distinct signal pattern.

SUMMARY OF THE INVENTION

The nonpolarized electrical connector assembly of the present invention provides a means for connecting an airbag inflation initiator or squib, including a smart squib, with an external sensor or controller over two or three or more signal lines. This connector assembly eliminates the need for polarization and shorting clips as well as the need for ferrites. The connector assembly can also fit within a smaller envelope than conventional squib connectors. The plug connector can be positioned at any angle relative to the mating axis between the plug connector and the receptacle connector. The receptacle connector can be mated with the airbag initiator eliminating the need to mount the connector terminals in the squib itself. The plug connector can also be latched to the receptacle connector in any 360° orientation. The connector assembly and the receptacle contacts are also suitable for transmitting signals of 50 ma. The invention depicted herein in the form of a preferred embodiment is an electrical connector assembly and a receptacle connector subassembly that accomplishes each of these objectives, and is adaptable to other applications and capabilities.

A receptacle connector subassembly, according to one aspect of this invention, is used to connect a mating plug having axially spaced plug contacts to an electronic component subassembly such as an airbag inflation initiator or squib. The receptacle connector subassembly includes a receptacle housing and a plurality of electrical contacts or terminals. The housing is partially insertable into a cavity in the electronic component subassembly. This housing receptacle has a central plug passage defined by an inwardly facing curved surface, which receives a mating plug. A plurality of slots extend axially along the curved surface at arcuately spaced locations around the central plug passage, and the receptacle contacts are inserted into these slots. Each receptacle contact has a electronic component mating section adjacent one end of the central plug passage and a plug mating section closer to an opposite end of the respective receptacle contact. The plug mating sections of separate receptacle contacts are located at different axial positions in the plug passage so that individual receptacle contacts can each engage aligned ones of the axially spaced plug contacts when the mating plug is inserted into the central plug passage of the receptacle housing. The mating plug need not be arcuately aligned relative to the individual receptacle contacts. In the preferred embodiment, a latch on the plug engages a latching shoulder on the receptacle housing for any mutual angular orientation between the plug and the receptacle. The receptacle is keyed relative to the electronic component or squib so that the receptacle terminals can be attached to leads or pins in the electronic component.

The receptacle contacts employed in the preferred embodiment of this invention each have a resilient beam extending in one direction from a central mounting section. A contact point on the resilient beam is spaced from the mounting section. The mounting section secures the receptacle contact in a connector housing. The receptacle contact also has a resilient component contact section extending in an opposite direction from the central mounting section. The component contact section including a contact slot open to one axial end of the receptacle contact. In the preferred embodiment of this invention the component contact section is in the form of a C-channel or clip. Both the contact slot and the contact point on the resilient beam are offset in the same direction relative to the mounting section so that both the contact point and the contact slot will protrude in the same direction relative to the housing when the receptacle contact in mounted in the housing.

BRIEF DESCRIPTION OF THE DRAWINGS

FIG. 2 is a top view of the airbag inflation initiator housing showing a cavity in which the electrical connector receptacle can be inserted.

FIG. 6 is a three dimensional view of short receptacle contact.

FIG. 7A is a three dimensional view of the receptacle housing.

FIG. 7B is a bottom view of the receptacle housing.

FIG. 7C is a side view of the receptacle housing.

FIG. 7D is a section view of the receptacle housing taken along section lines 7D—7D in FIG. 7A.

DETAILED DESCRIPTION OF THE PREFERRED EMBODIMENT

Figure 1:
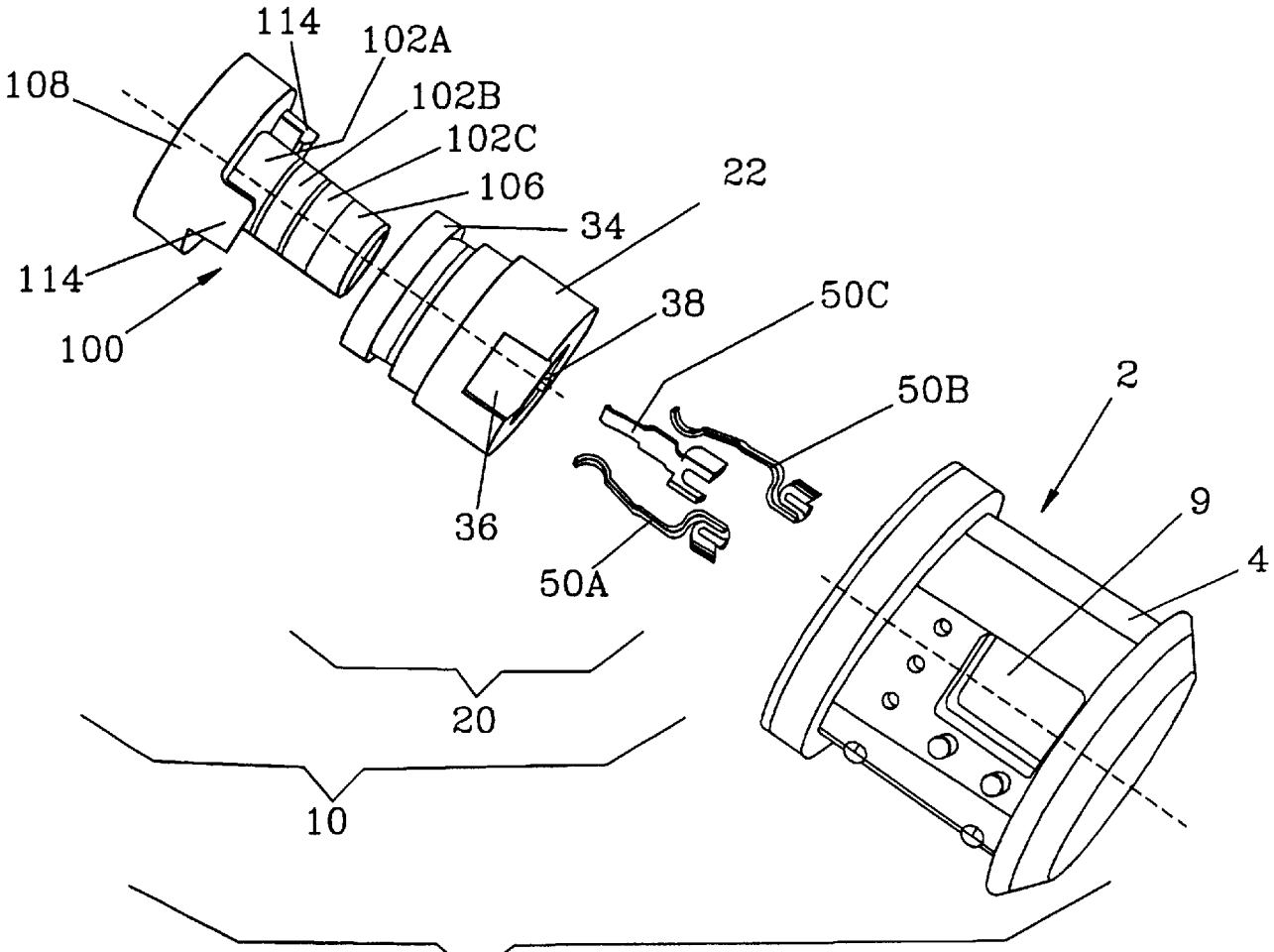
FIG. 1 is an exploded view of the components of the squib electrical connector assembly and an airbag inflation initiator or squib to which the electrical connector can be mated in any angular orientation about a central axis.

The electrical connector assembly 10 comprising the preferred embodiment of this invention comprises a receptacle connector subassembly 20 and a plug connector subassembly 100. This electrical connector assembly 10 is intended to mate with an airbag inflation initiator or squib as shown in FIG. 1. This assembly 10 permits the plug connector subassembly 100 to be mated to the receptacle connector subassembly 20 in any angular orientation relative to the mating axis of the two connector subassemblies shown in FIG. 1. It follows then that the plug connector 100 can be positioned in any angular orientation relative to the airbag initiator or squib 2. The plug connector 100 therefore need not be polarized relative to either the receptacle connector 20 or the squib 2. Although primarily intended for use as a squib connector, the connector assembly 10 could be employed with other devices, either in automotive or motor vehicle applications or in any number of other applications that are not related to automotive applications.

The airbag initiator or squib 2, referred to herein more generally as an electronic component or electronic component subassembly, with which this connector assembly 10 is employed comprises a housing 4 having a cavity 5 extending into the housing 4 from an exposed face or end of the subassembly 2. Three electrical contact pins 6 extend perpendicularly relative to the cavity axis and across the cavity 5 as shown in FIG. 2. These pins 6 are recessed relative to the exposed face of the housing 4. A polarizing key 7 is located along one side of the cylindrical cavity 5. This squib 2 is referred to as a smart squib because it incorporates an integrated circuit component (not shown) to activate the airbag initiator in response to signal transmitted to the integrated circuit component through the connector subassembly 10 and through pins 6 that are permanently connected to the integrated circuit component. FIG. 1 shows a housing compartment 9 in which the integrated circuit component can be mounted.

Figure 3:
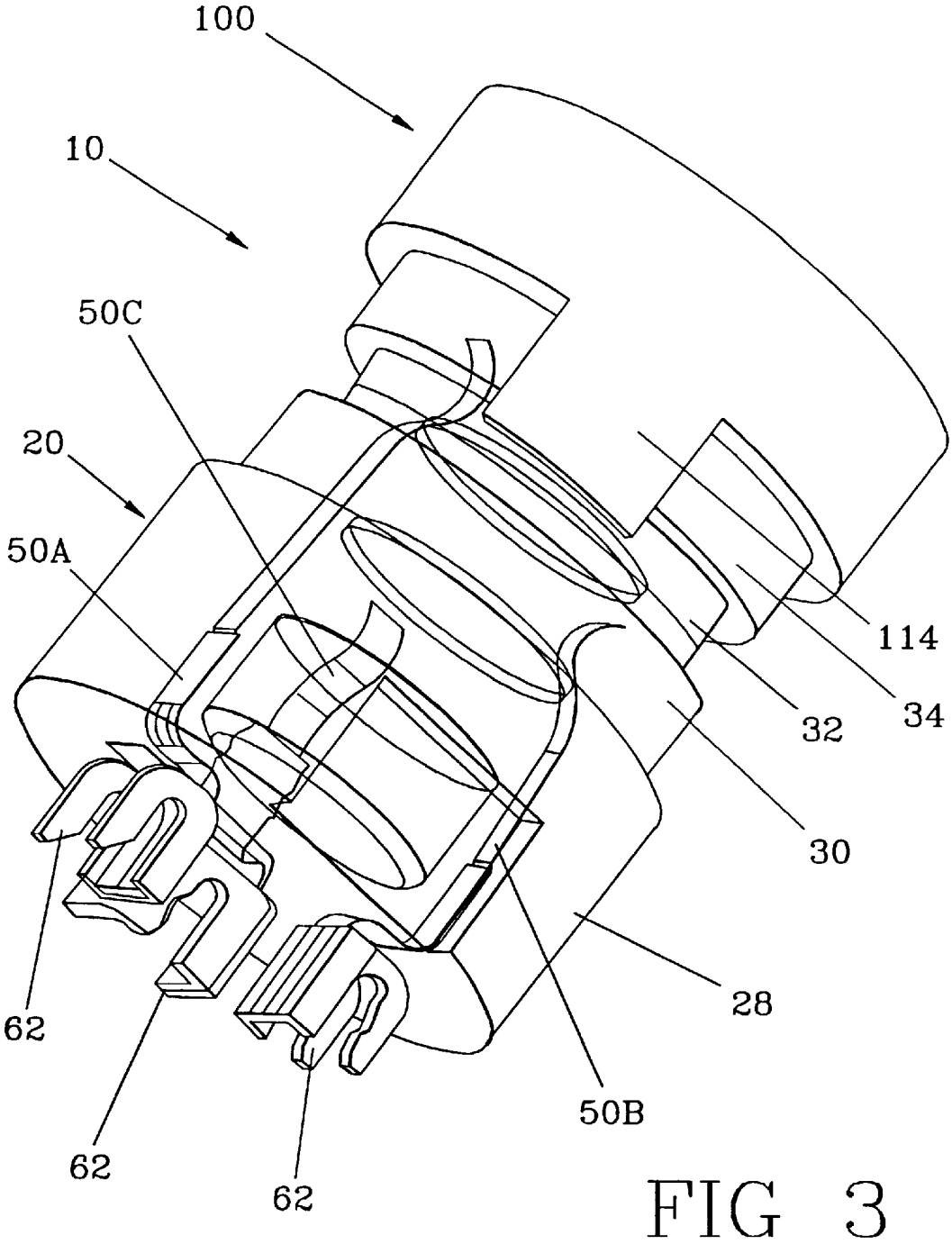
FIG. 3 is a view showing the plug connector subassembly and the receptacle connector subassembly in a mated configuration. Portions of the receptacle contacts that would otherwise be hidden in this view are shown in conjunction with the location of plug contact areas in this wireframe style drawing to show the manner in which the receptacle contacts engage axially spaced plug contacts.

Electrical connection to the squib 2 is provided by the two part electrical connector assembly 10. The receptacle connector subassembly 20 is mounted to the airbag initiator or squib 2, with the receptacle connector subassembly partially inserted and positioned in the cavity 5. In order to connect an external sensor or other signaling device to the airbag initator or squib 2, the plug connector subassembly 100 is then mated to the receptacle subassembly 20 by inserting the plug post 106 with three cylindrical axially spaced plug contacts 102A, 102B, and 102C into the central plug passage or bore 38 extending into the cylindrical receptacle connector housing 22. FIG. 3 shows the plug connector subassembly 100 mated to a freestanding receptacle connector subassembly 20. It should be understood that FIG. 3 is intended merely for illustrative purposes and the plug connector subassembly 100 would not be mated to the receptacle connector subassembly 20 in this configuration. In practice, the receptacle connector subassembly 20 would be first mated to the airbag initiator or smart squib 2 and this combination would be mounted in a vehicle. The plug connector subassembly 100, and the harness wires to which it would be attached, would only be mated to the previously positioned receptacle connector subassembly 20 as part of a later assembly operation or a later repair or servicing procedure. FIG. 3 does demonstrate however the relative positions of the two connector subassemblies when mated and does show the latches 114 on the plug connector housing 104 as they engage a companion peripheral latching shoulder 34 on the exterior of the receptacle housing 22 to secure the plug connector subassembly 100 to both the receptacle connector subassembly 20 and the smart squib 2.

Figure 4:
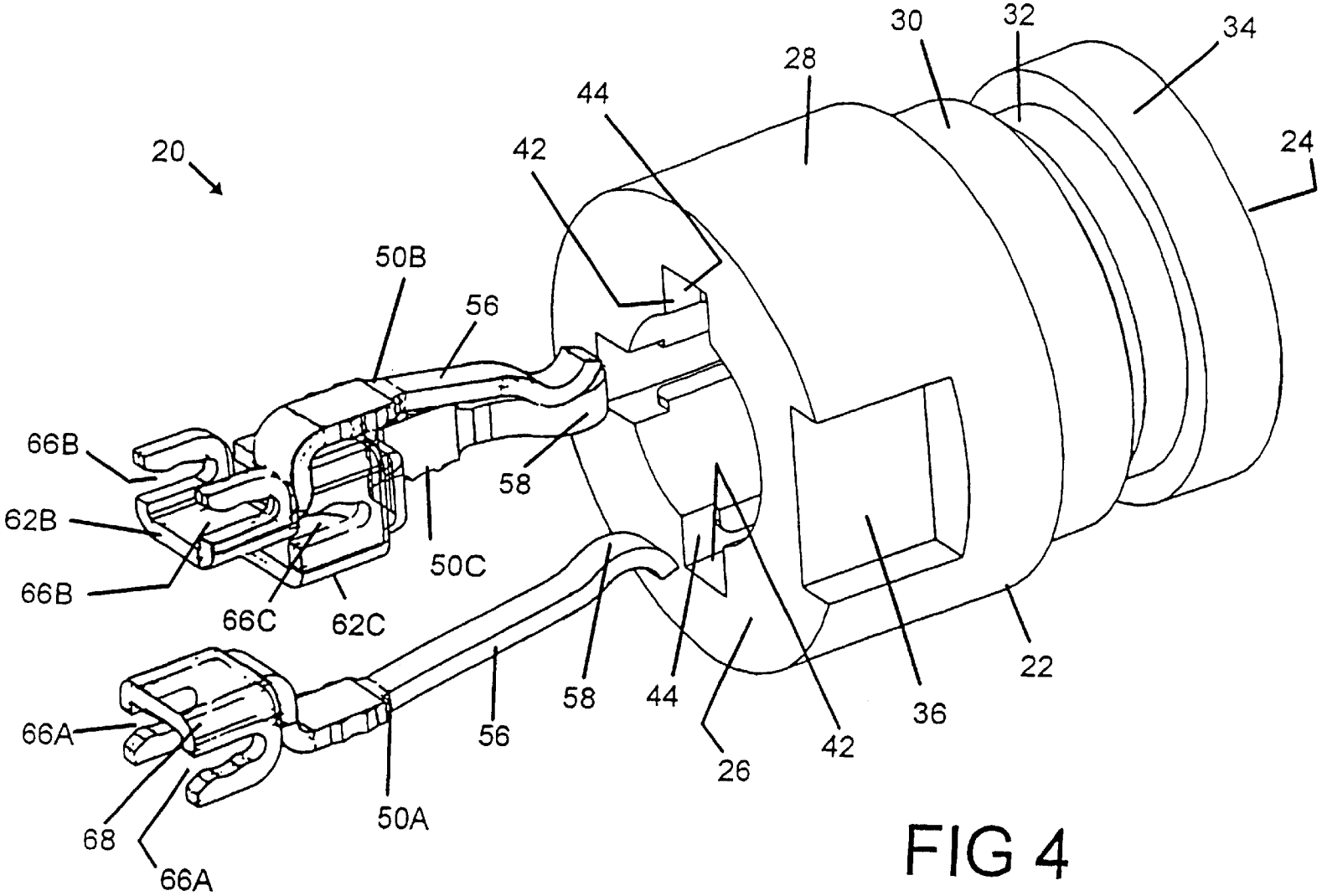
FIG. 4 is a view of the receptacle connector subassembly with three receptacle contacts shown in an exploded position relative to the receptacle connector housing.
Figure 5A:
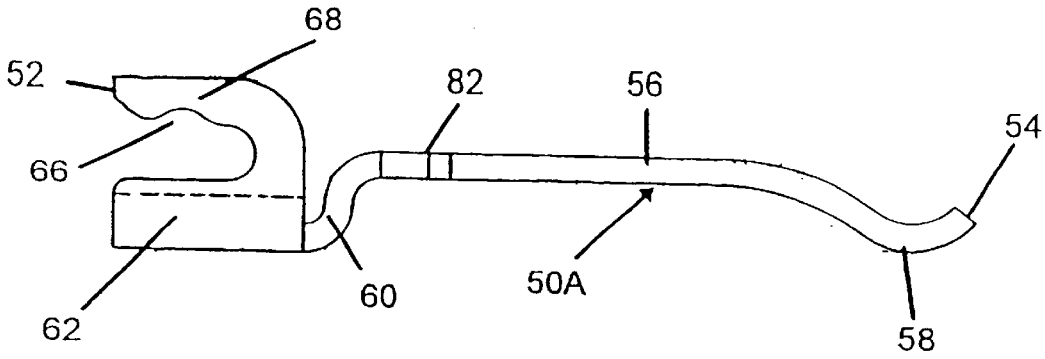
FIG. 5A is a side view of a long receptacle contact.
Figure 5B:
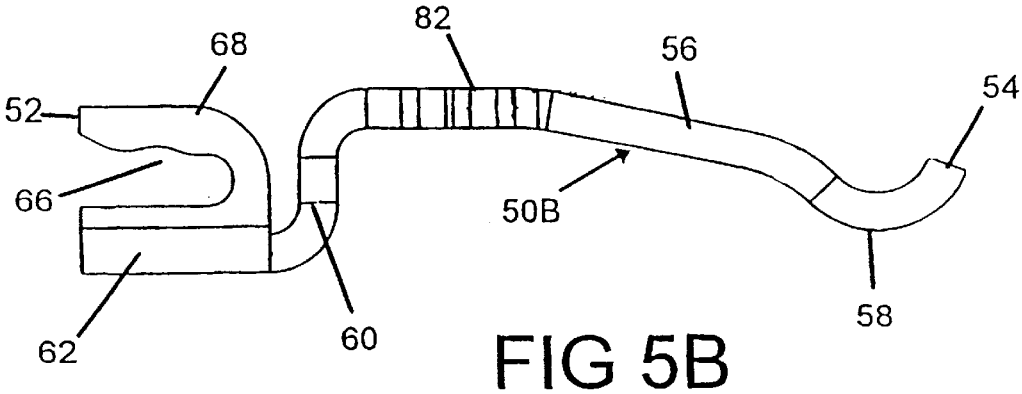
FIG. 5B is a side view of a middle receptacle contact.
Figure 5C:
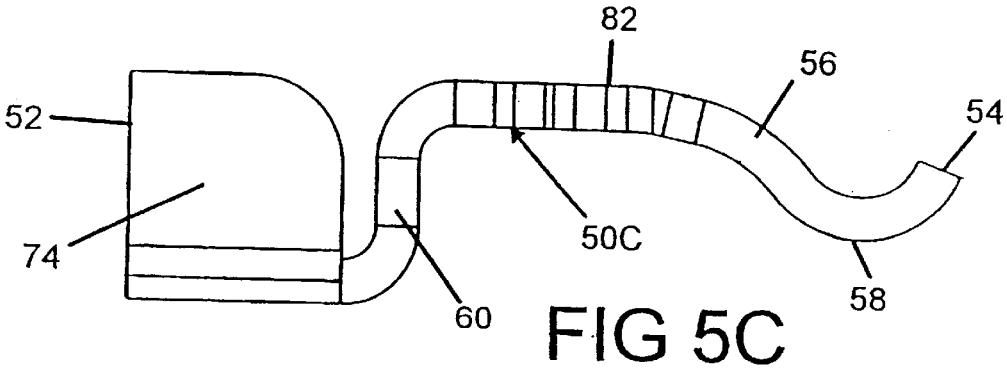
FIG. 5C is a side view of a short receptacle contact.

FIGS. 4–6 show additional details of the receptacle connector subassembly 20, which comprises a molded receptacle housing 22 and three receptacle contacts 50A, 50B and 50C that are positioned in slots 42 surrounding a central plug passage or bore 38 that extends between an exterior face or end 24 and an interior housing end or face 26. In the preferred embodiment, the housing 22 is molded in one piece from a plastic material, such as a conventional polyeitherimide (PEI) having high creep resistance. The receptacle contacts or terminals 50A, 50B and 50C are stamped and formed, each in one piece, from a conventional spring metal, having a thickness of 0.25 mm, with contact areas appropriately plated for corrosion resistance and contact stability. The thickness of all of the contacts 50A, 50B, 50C is the same in the preferred embodiment of this invention.

The molded receptacle housing 22 shown in FIGS. 4 and 7A–D has a toroidal configuaration or cross section defined by a cylindrical outer surface and a central inner passage 38 defined by a generally cylindrical inwardly facing surface 40 which is interpreted by a series of axially extending slots 42. The central inner passage 38 is dimensioned to receive the post section 106 of the plug connector subassembly 100 so that electrical connector can be made with the three axially spaced plug contacts 102A, 102B, and 102C extending concentrically around the plug post 106. The three axially extending slots 42 are dimensioned to mount the three receptacle contacts 50A, 50B, and 50C at three arcuately spaced locations on half of the cylindrical surface 40. Receptacle contact 50A will be positioned ninety degrees from receptacle contact 50C, which will in turn be positioned ninety degrees from receptacle contact 50B, which is opposed to contact 50A.

The central plug receiving passage 38 extends between opposite end faces or surfaces 24, 26 on the receptacle housing 22. Interior housing face 24 will be positioned adjacent the base of the cavity 5 when the receptacle connector subassembly 20 is mated to the squib 2. The exterior housing end face 26 will extend beyond the squib housing 4 when the receptacle connector subassembly 20 is fully mated to the squib 2. A polarizing notch 36 extends into the exterior cylindrical face of the receptacle housing 22 adjacent to the interior face 26 and opposite from the slot 42 in which the short receptacle contact 50C is positioned. This polarizing notch 36 receives the polarizing key 7 on the squib housing 4. The receptacle connector subassembly 20 is polarized or keyed relative to the airbag initiator 2 so that the receptacle contacts 50A, 50B and 50C will be properly positioned in alignment with the corresponding pins 6. It should be understood, however, that while the receptacle connector subassembly is keyed, polarized or properly angularly positioned relative to the squib 2, the plug connector subassembly 100 still does not have to be polarized or keyed or angularly oriented or aligned with either the receptacle connector subassembly 20 or the airbag initiator 2.

The cylindrical or toroidal receptacle housing 22 has four sectors, all of which form a single one piece molded body. The first or lower housing sector 28 located adjacent to the interior face 24 has the largest outer dimension. It is this first section that will be received in the cavity 5 when the receptacle connector subassembly 20 is mated to the squib airbag initiator 2, and the polarizing notch 36 is located in this housing sector 28. An adjacent second housing sector 32 has a smaller external diameter and a next adjacent third housing sector 34 has the smallest outer diameter on the housing 22. A lip or ring 34 is located at the exterior end 26 of the housing 22, and this ring 34 has a larger outer diameter than the sector 32 to which it is adjacent. This ring 34 serves as a latching shoulder that is engaged by a plug latch 114 when the plug connector subassembly 100 is mated to the receptacle connector subassembly 20. The smaller sector 32 provides clearance for the plug latch 114. Since the shoulder or ring 34 extends completely around the periphery of the receptacle housing 22, the plug latch 114 can engage the shoulder 34 at any angular position so that the plug connector subassembly can be mated in any angular orientation and is free to rotate once mated.

Each of the receptacle contacts 50A, 50B and 50C can be positioned in the receptacle housing 20 by inserting the contacts from the interior housing end 24 into the slots 42 located along the inwardly facing curved passage surface 40. Each of the slots 42 is recessed relative to the curved surface 40 and thus extends radially outward from this inwardly facing surface 40. Sidewalls 44 define the slots 42 and ribs 46 on the walls 44 serve to restrict the receptacle contacts after they have been inserted behind the ribs 46. Each of the receptacle contacts 50A, 50B and 50C has a mounting section 82 with teeth 84 extending from opposite edges of the mounting section 82. These teeth engage the sidewalls 44 when the receptacle contacts are inserted into slots 42 and prevent extraction of the contacts as well as stabilizing the receptacle contacts 50A, 50B and 50C in the receptacle housing 22. When the receptacle contacts 50A, 50B, 50C have been fully inserted into the slots 42, each of the receptacle contacts will have a contact point or area 58 located between outer housing faces 24, 26 at opposite ends of the housing 22. Electronic component contact sections 62 located on one end of each receptacle contact 50A, 50B and 50C will protrude beyond the interior receptacle housing face 24 so that these component contact sections 62 will be in position to engage the pins 6 extending perpendicular to the axis of the plug passage 38 and the cavity 5 in the initiator 2.

Each of the stamped and formed contacts 50A, 50B and 50C has a resilient cantilever contact beam 56 extending from the central contact mounting section 82 toward a free end 54 that will be facing the exterior end of the receptacle contact. In other words, contact free end 54 will be the first portion of the contact to engage the plug connector when it is inserted into plug passage 38. A raised contact point or area 58 is located adjacent the free end 54 and comprises the innermost part of each receptacle contact 50A, 50B and 50C so that it will engage a corresponding and aligned plug contact 102A, 102B, and 102C extending around the periphery of the plug post or pin 106. When the contact point 58 engages the plug contact 102A, 102B, or 102C, the cantilever contact beam is flexed generating a contact force sufficient to maintain a reliable contact between the plug contacts and the corresponding receptacle contact 50A, 50B or 50C. The cantilever beams 56 on different receptacle contacts have different lengths so that the axial positions of the contact points 58 on different receptacle contacts 50A, 50B and 50C will be mutually axially spaced or offset. In this way individual receptacle contacts 50A, 50B and 50C will engage different axially spaced plug contacts 102A, 102B, and 102C when the plug connector 100 is properly mated with the receptacle connector 20. A long receptacle contact 50A has the longest cantilever beam 56 so that its contact point 58 will be closest to the exterior end 26 of the receptacle connector where it will engage a peripherial plug contact 102A closest to the exterior receptacle end 26. A middle receptacle contact 50B has a somewhat shorter cantilever beam 56 so that its contact point 58 will engage a middle plug contact 102B. Short receptacle contact 50C has the shortest cantilever beam 56 so that it will be aligned with the first plug contact 102C to be inserted into the plug passage 30 as the two connectors are mated. Since the plug contacts 102 extend completely around the plug housing, it is only the axial positions of the plug contacts 102A, 102B, 102C and the receptacle contacts 50A, 50B, 50C that result in mating between corresponding contacts.

The three receptacle contacts 50A, 50B and 50C each have a resilient electronic component mating section 62 on the opposite side of the mounting section 82 from the resilient cantilever contact beam 56. Each of these component mounting sections 62 comprise a C-channel or C-clip for engaging one of the parallel pins 6 in the squib component 2. The long receptacle contact 50A and the middle receptacle contact 50B have identical C-channel contact sections 62 because these contacts are positioned so that the corresponding pin 6 will extend generally tangent to the mounting section 82 and the resilient beam 56. These receptacle contacts 50A and 50B are positioned opposite each other with the short receptacle contact 50C located between the other two receptacle contacts. The short receptacle contact 50C will thereof be positioned so that its the central component pin will extend generally perpendicular to the plate of the mounting section 82 and the cantilever beam 56 on the short receptacle contact 50C. Each receptacle component contact section 62 does have at least one component contact slot 66 open on one end of the receptacle contact and extending axially relative to the receptacle contact and to the central passage or bore 38. Pins 6 will therefore be aligned with and received in corresponding slots 66 when the receptacle contact is mated with the squib component 2.

The long receptacle contact 50A and the middle receptacle contact 50B each has two slotted flat plate sections 68 extending inwardly from one end of the spaced flat plate 68. Slots 66 formed in these flat plate sections 68 have one edge with a recessed portion in which one of the pins 3 will fit so that a reliable electrical connector can be made between the receptacle contacts 50A and 50B and the corresponding pins 3. Force is required to either insert the pins 3 or remove the pins 3 from the slots 66. The slots 66 in the two flat plate sections 68 are aligned and the two flat plate sections 68 are joined by a central section 70 which joins the component contact section 62 to the remainder of the receptacle contact 50A or 50B. The central section 70 is joined to an offset section 60 between the mounting section 82 so that the component contact section 62 and the contact point 58 will both be on the same side of the mounting section. Both the component contact section 62 and the cantilever beam contact point 58 will then extend inwardly relative to the curved housing wall 40 into the plug passage 38.

The short receptacle contact 50C also has a component contact section 62 formed by two flat plate sections 74 bent at right angles relative to a central flat plate section 72 to form a U-shaped configuration. The component slot 66 in the short receptacle contact 50C is however located in the central flat plate section 72 so that it will be properly oriented relative to a pin extending perpendicular to the stamped and formed short receptacle contact mounting section and resilient cantilever beam. The central flat plate section 72 is also joined to an offset section 60 so that both the short receptacle contact component mating section 62 and the resilient contact beam 56 will be positioned to extend into the plug passage or bore 38 when mounted in the corresponding housing slot 42.

Figure 8:
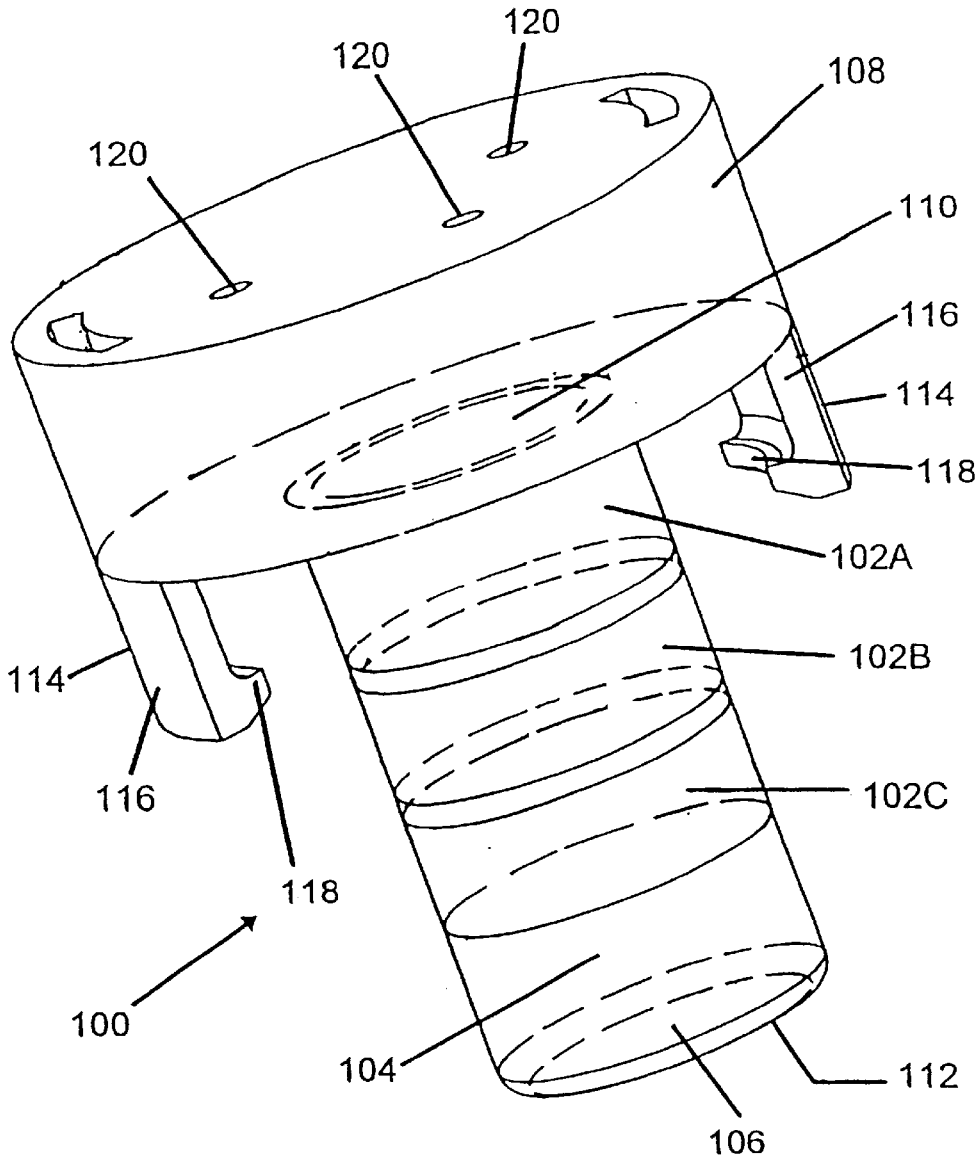
FIG. 8 is a view of the plug connector subassembly.
Figure 9:
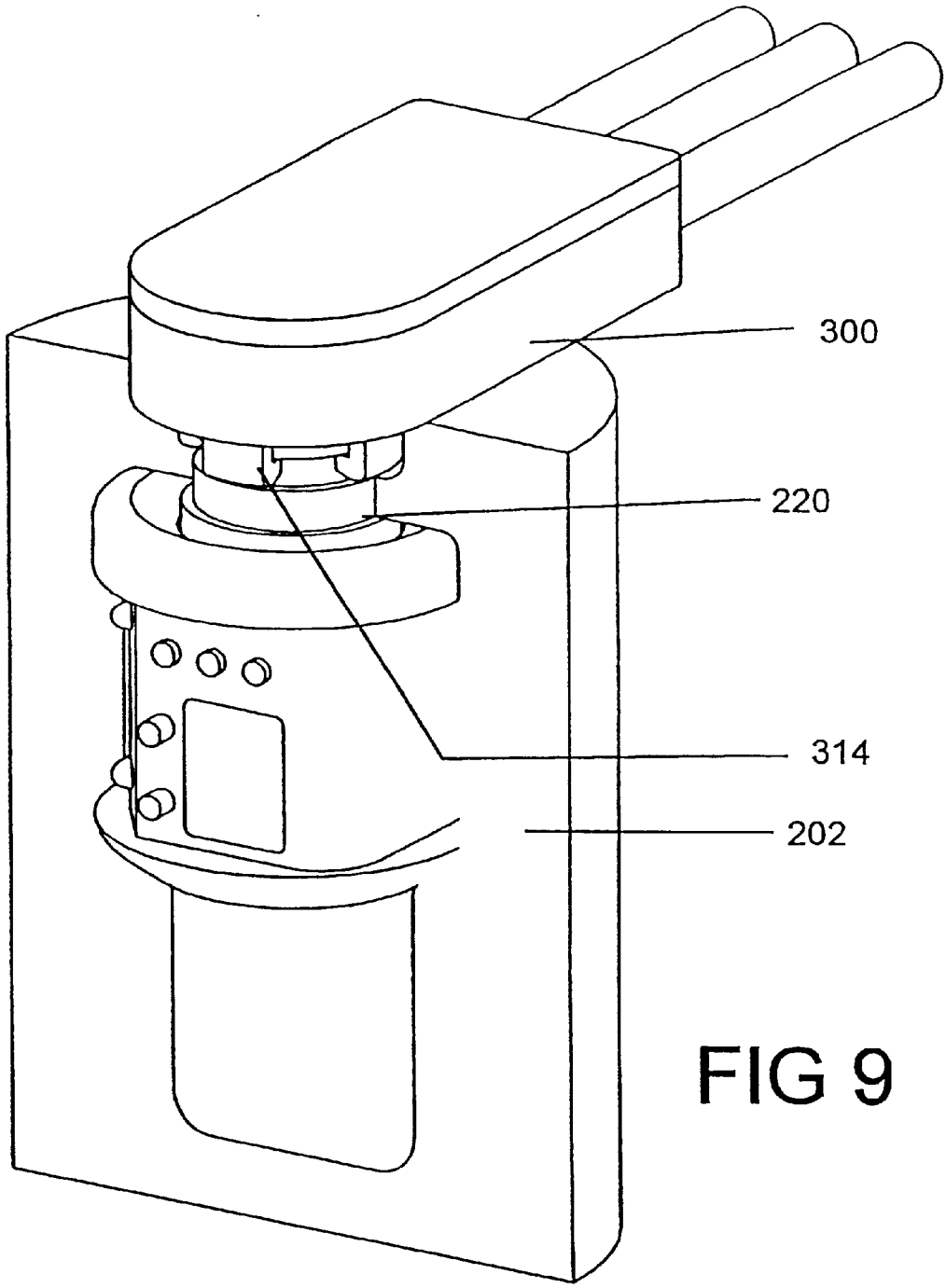
FIGS. 9–14 are alternative embodiment of a smart squib electrical connector assembly.
Figure 10:
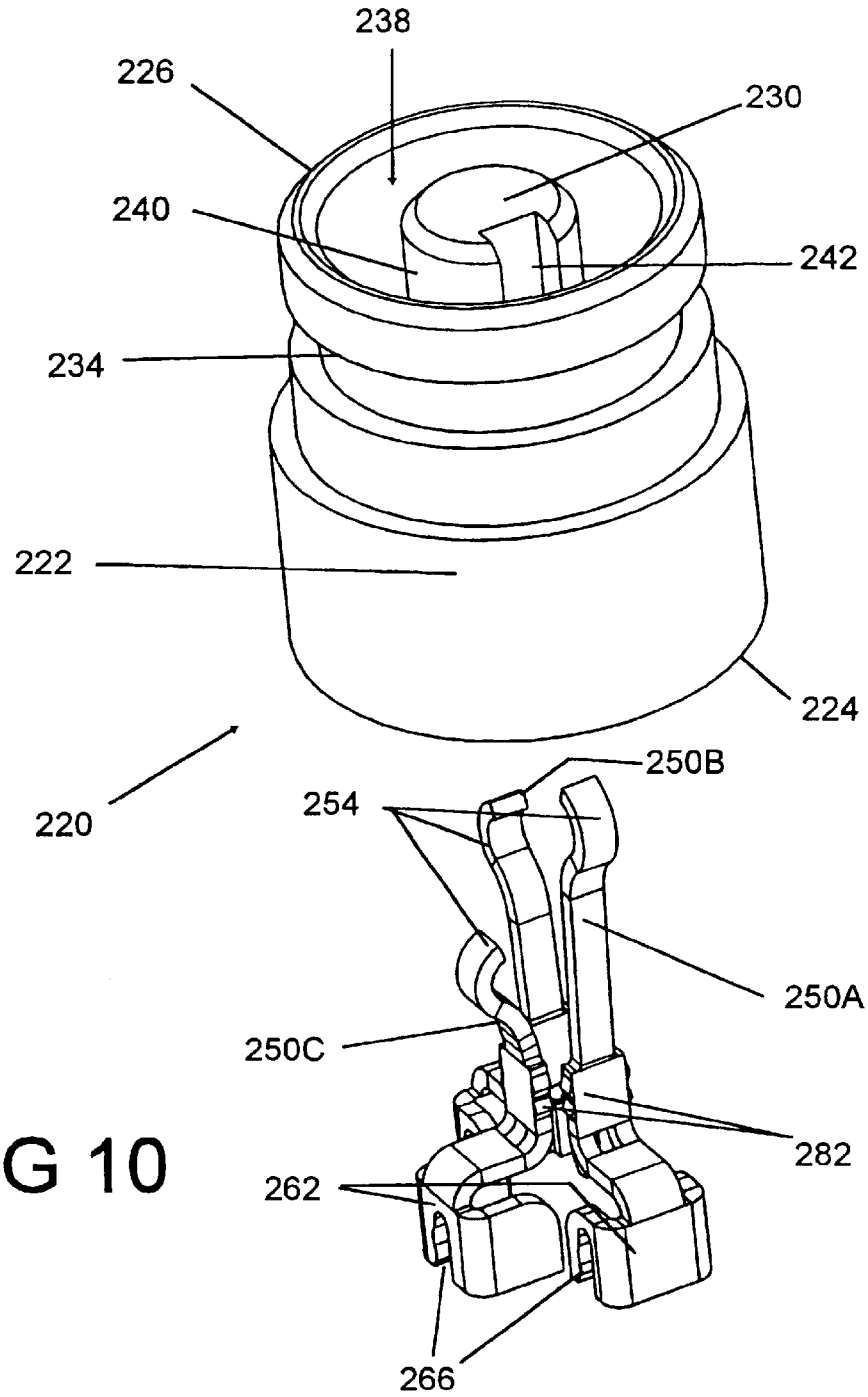
Figure 11:
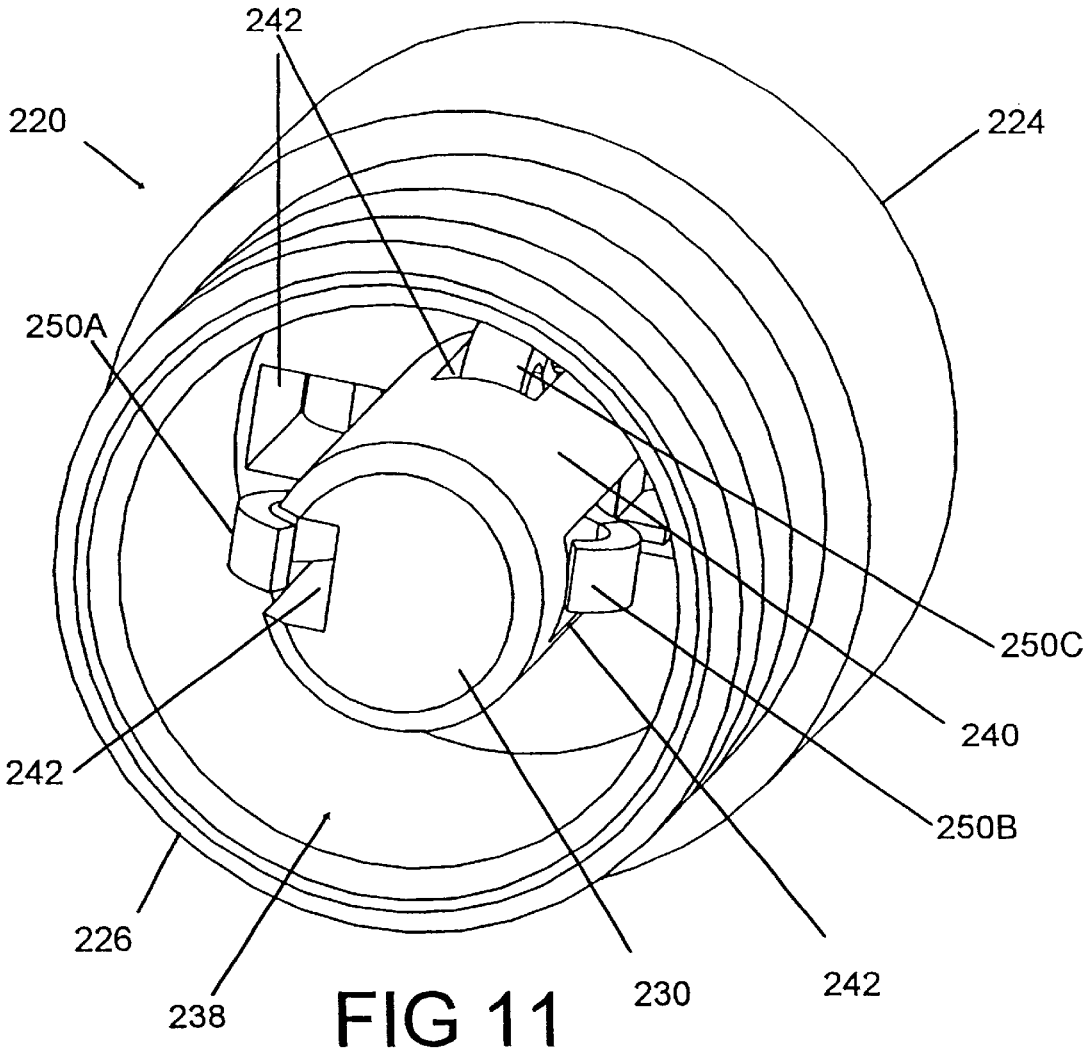
Figure 12:
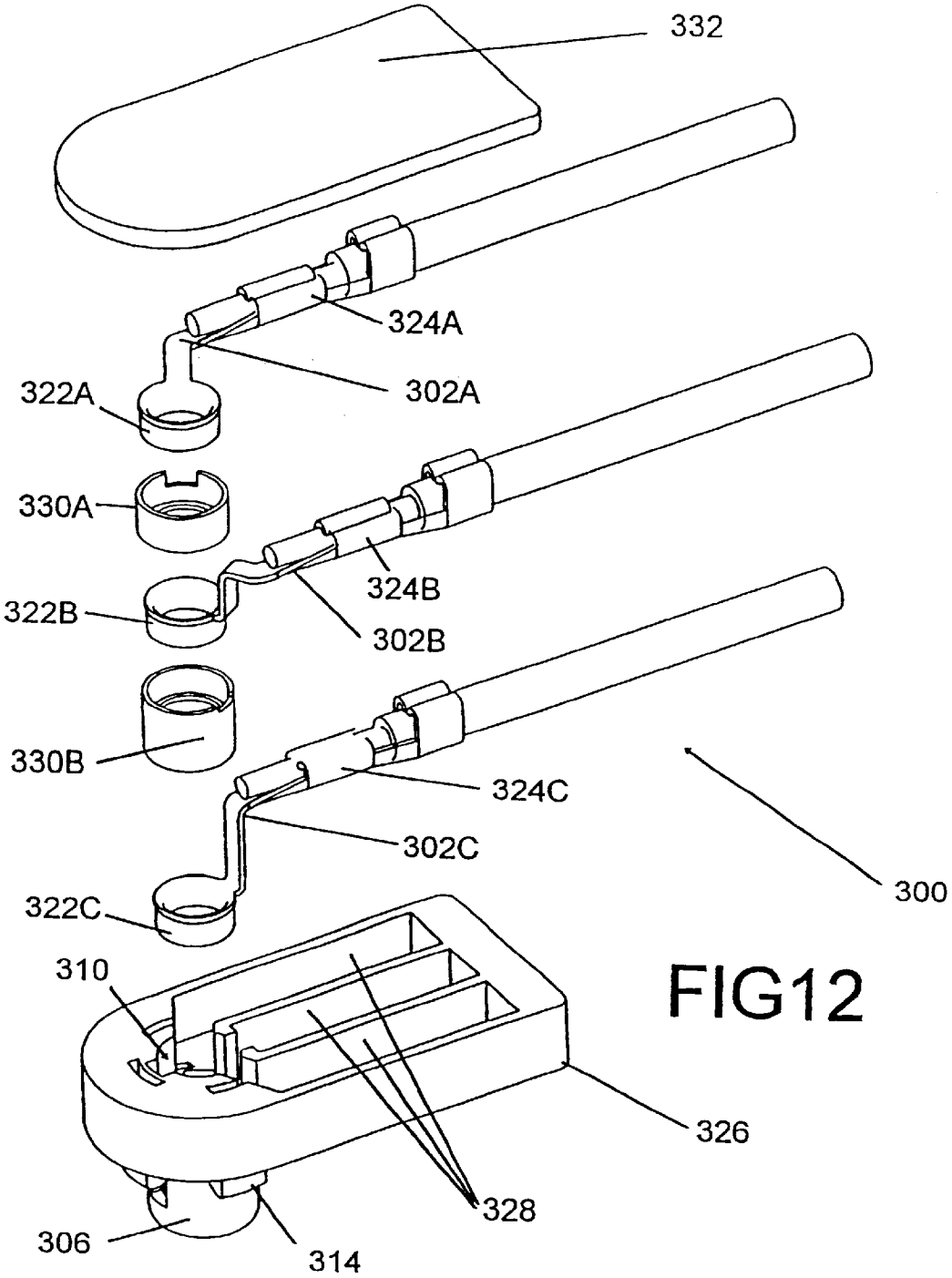
Figure 13:
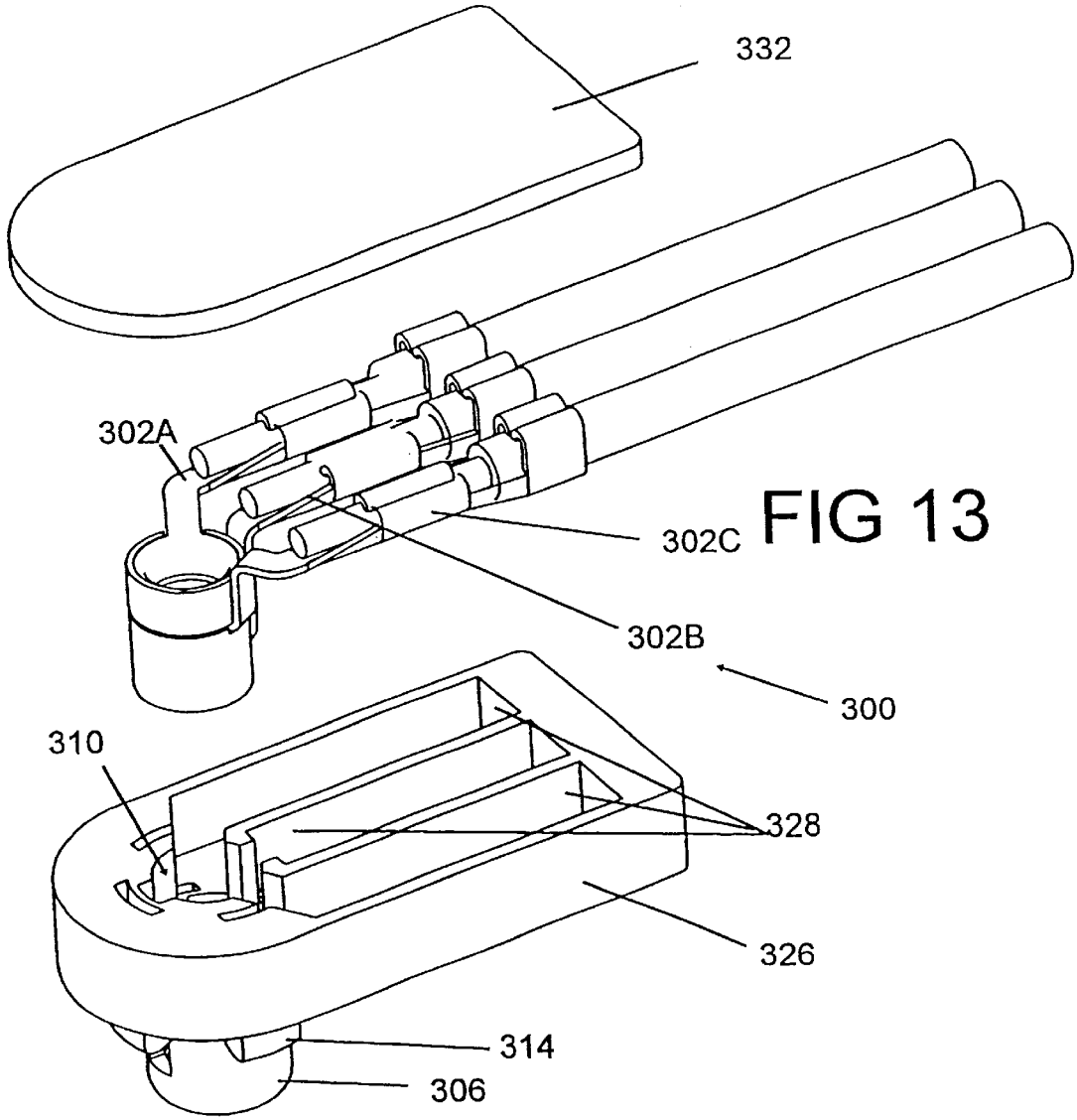
Figure 14:
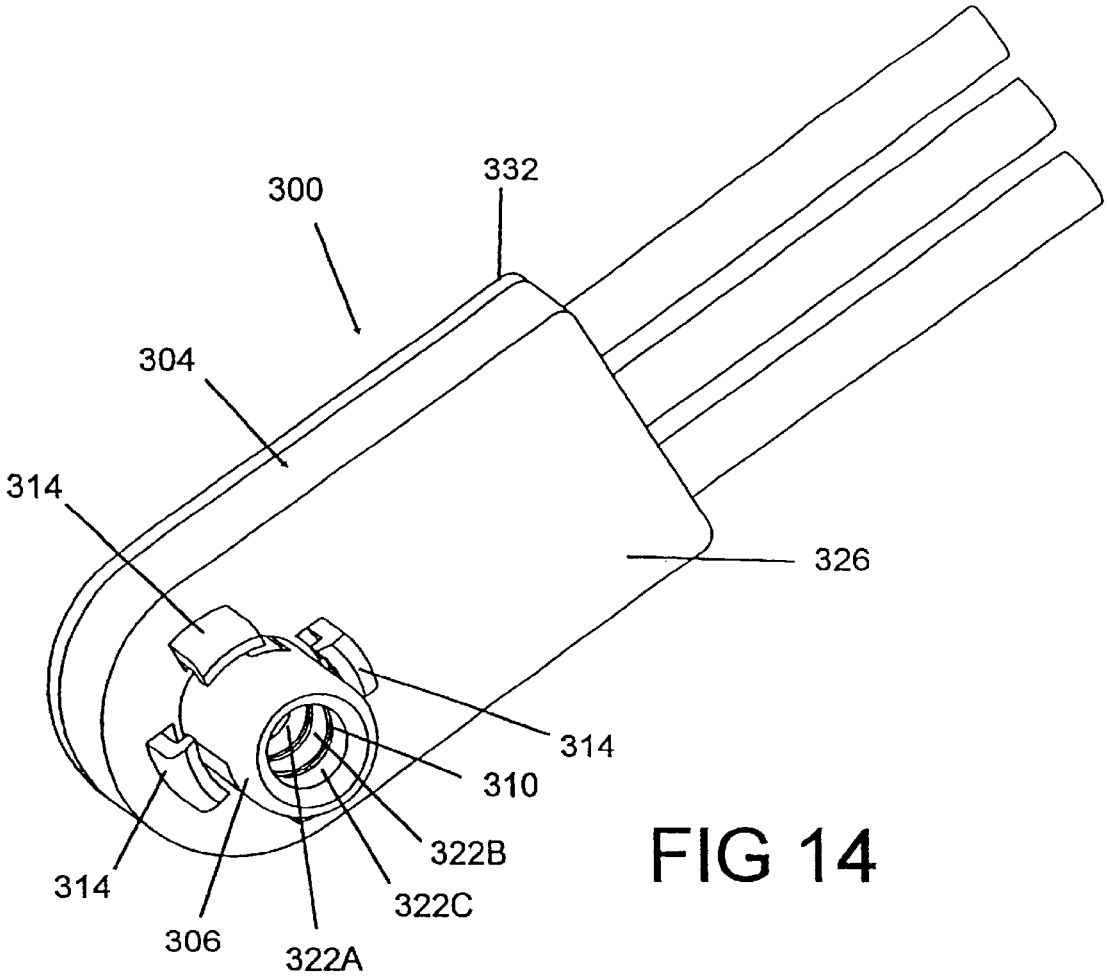

The plug connector subassembly 100 comprises a plug housing 104, also molded from a polyetherimide material, and three peripheral plug contacts 102A, 102B, 102C spaced axially along a central plug housing post 106. As shown in FIG. 8, the cylindrical post 106 extends from a larger plug cap 108 having a larger outer diameter. A bore 110 extends through the plug post 106 and joins three conductor passageways 120 through which individual conductors or wires (not shown) can be inserted so that the wires can be terminated to respective plug contacts 102A, 102B, and 102C. The cylindrical plug contacts 102A, 102B, and 102C are located on the exterior surface of the post 106 where they will contact the contact points 58 on receptacle contacts 50A, 50B and 50C when the plug connector subassembly 100 is fully inserted into the plug passage 38 in the receptacle connector subassembly 20. Adjacent plug contacts 102A, 102B, and 102C are spaced apart by gaps and the endmost plug contact is spaced from the leading edge 112 of the post which first enters the receptacle housing 22.

Two molded plug latches 114 extend from the periphery of the plug cap 108 and radial gap is formed between each latch 114 and the opposed plug post 106 having a smaller outer diameter. Each latch 114 has a flexible latch beam 116 with an inwardly facing latch boss 118 located on the distal end of the latch beam 116. The latches 114 are configured so that the latch bosses 118 engage the peripheral latching shoulder 34 on the receptacle connector housing 22 to secure the plug connector subassembly 100 to its mating receptacle subassembly 20. The latch and the latching shoulder engage regardless of the angular orientation of the to connector subassemblies.

This preferred connector assembly 10, which is representative of other equivalent configurations is capable of supplying either two or three signal transmission lines to and/or from an electronic component such as an airbag inflation initiator or squib 2 using only a single male connecting member or plug post 106 and does not require polarization, keying or alignment of the plug connector assembly 100 relative to electronic component 2, the receptacle contacts 50A, 50B or 50C or the receptacle connector subassembly 20. No shorting bars are required for this connector assembly. For the preferred embodiment of this invention the long receptacle contact 50A mates with the uppermost plug contact 102A, and this pair of terminals comprises a first signal path. The middle receptacle contact 50B mates with the middle plug contact 102B, and this pair of terminals comprises a second signal path. The short receptacle contact 50C mates with the lowermost plug contact 102C, and this pair of terminals comprise a third signal contact. Of course one of these signal paths could be dedicated to ground or could supply a timing signal or could comprise a path for other purposes. In the preferred embodiment signals of 50 ma are transmitted on these signal paths. This connector assembly also has a relatively small size or envelope. For instance, the mated plug and receptacle connector assembly has a length of 9.5 mm and a maximum outside diameter of 6.2 mm. The plug connector 100 can be mated with to the receptacle connector subassembly 20 without stubbing and the contacts have excellent floating characteristics. These characteristics make the connector assembly 10 especially suitable for use as a squib or airbag inflation initator connector, but the basic connector system can be used for other automotive as well as nonautomotive applications. This invention is also not limited to the use of two or three plug and receptacle contacts and is suitable for use with more that three contacts. This connector assembly is therefore representative of other configurations employing the same or equivalent elements as would be understood by one of ordinary skill in the art. Therefore this invention is not limited to the preferred embodiment depicted herein, but is instead defined by the following claims.

We claim:

1. A nonpolarized electrical connector for use in transmitting electrical signals on at least two signal lines to and from an electronic component, comprising a plug connector subassembly and a receptacle connector subassembly, the plug connector subassembly being insertable into mating relationship with the receptacle connector subassembly along a mating axis; the plug connector subassembly having plug contacts axially spaced on a single protruding member; the receptacle connector subassembly comprising a receptacle housing insertable at least partially into a cavity in the electronic component and including means for keying the receptacle housing relative to the cavity in the electronic component, the receptacle connector assembly also including receptacle contacts arcuately spaced in the receptacle housing, the receptacle contacts having contact points, with contact points on separate receptacle contacts being mutually axially offset, whereby the plug connector subassembly can be mated to the receptacle connector subassembly with the plug connector subassembly in any angular orientation relative to the receptacle connector subassembly and relative to the electronic component.

2. The nonpolarized electrical connector assembly of claim 1 wherein the plug connector subassembly includes a latch attachable to a latching surface on the receptacle housing for securing the plug connector subassembly to the receptacle connector subassembly.

3. The nonpolarized electrical connector assembly of claim 2 wherein the latching surface comprises a continuous circular shoulder so that the plug connector subassembly can be mated to the receptacle connector subassembly in any arcuate position.

4. The nonpolarized electrical connector assembly of claim 2 wherein the latch is rotatable relative to the latching surface so that the latch and latching surface prevent retraction of the plug connector subassembly from the receptacle subassembly along the mating axis but permit arcuate movement of the plug connector subassembly relative to the receptacle subassembly.

5. The nonpolarized electrical connector assembly of claim 1 wherein the receptacle connector includes a cylindrical passage comprising means for receiving the post on the plug connector subassembly.

6. A nonpolarized squib electrical connector assembly for use with an airbag inflation initiator, comprising a plug connector subassembly and a receptacle connector subassembly, the plug connector subassembly being insertable into mating relationship with the receptacle connector subassembly along a mating axis; the plug connector subassembly having plug contacts axially spaced on a single protruding member; the receptacle connector subassembly comprising a receptacle housing and receptacle contacts arcuately spaced on the receptacle housing, the receptacle contacts having contact points, with contact points on separate receptacle contacts being mutually axially offset, the receptacle subassembly being at least partially insertable into a cavity in the airbag inflation initiator, whereby the plug connector subassembly can be mated to the receptacle connector subassembly in any angular orientation relative to the mating axis.

7. The nonpolarized squib electrical connector assembly of claim 6 wherein the plug connector subassembly includes a latch attachable to a latching surface on the receptacle housing for securing the plug connector subassembly to the receptacle connector subassembly.

8. A nonpolarized squib electrical connector assembly for use with an airbag inflation initiator, comprising a plug connector and a plurality of receptacle contacts; the plug connector having axially spaced plug contacts on a single protruding member and a latch for securing the plug connector relative to the airbag inflation initiator; separate receptacle contacts being arcuately spaced relative to other receptacle contacts with individual receptacle contacts having contact points axially spaced relative to contact points on other receptade contacts, the receptacle contacts being at least partially insertable into a cavity in to mate with the airbag inflation initiator; whereby the plug connector can be mated to the receptacle contacts in any angular orientation.

* * * * *